US005335829A

United States Patent [19]

Sovann

[11] Patent Number: 5,335,829

[45] Date of Patent: Aug. 9, 1994

[54] KNOCKDOWN DISPENSER KIT

[76] Inventor: Nancy Sovann, 1707 Sahara La., Mitchellville, Md. 20716

[21] Appl. No.: 991,299

[22] Filed: Dec. 15, 1992

[51] Int. Cl.[5] ..... B65D 5/00

[52] U.S. Cl. ..... 222/183; 222/185; 222/522; 222/525; 222/501

[58] Field of Search ..... 222/185, 501, 522, 525, 222/183; 141/348, 349, 363

[56] References Cited

U.S. PATENT DOCUMENTS

| | | | |
|---|---|---|---|
| 796,256 | 8/1905 | Sanders | 222/525 X |
| 991,568 | 5/1911 | Walter | 222/185 X |
| 996,127 | 6/1911 | Patnaude | 141/363 X |
| 1,165,711 | 12/1915 | Ransom, Jr. | 222/525 X |
| 2,058,027 | 10/1936 | Martinet | 222/185 X |
| 2,453,080 | 11/1948 | Shimp | 222/185 |
| 2,570,283 | 10/1951 | Stevens | 222/185 X |
| 2,751,119 | 6/1956 | Manning, Sr. | 222/525 X |
| 2,901,153 | 8/1959 | Collins | 222/525 |
| 3,157,323 | 11/1964 | Kitterman | 222/525 X |
| 4,375,864 | 3/1983 | Savage | 222/501 X |
| 4,380,310 | 4/1983 | Schneiter et al. | 222/501 |
| 4,903,742 | 2/1990 | Gagnon | 222/501 X |
| 4,928,855 | 5/1990 | Ramsey | 222/185 X |
| 5,095,962 | 3/1992 | Lloyd-Davis et al. | 141/349 X |
| 5,118,009 | 6/1992 | Novitsky | 222/325 X |
| 5,222,531 | 6/1993 | Baker et al. | 222/185 X |
| 5,222,631 | 6/1993 | Hood | 222/185 X |

*Primary Examiner*—Kevin P. Shaver

[57] ABSTRACT

A portable beverage dispenser for use with two liter beverage bottles. The dispenser supports bottles in an inverted position and is suited to be placed on a horizontal surface for outdoor use. A plurality of independent cap units are located on each bottle. A support cabinet is provided for housing the bottles during use.

8 Claims, 3 Drawing Sheets

KNOCKDOWN DISPENSER KIT

BACKGROUND OF THE INVENTION

Carbonated beverages are sold in plastic bottles of a two liter capacity. The beverages are usually served straight from the bottle which often leads to decarbonation and warming of the beverage. At outdoor events, container closures are often quickly lost causing decarbonation of the beverage before the event is over. The use of more than one type of beverage at outdoor events causes inconvenient handling and dispensing.

There have been few attempts in the field to provide outdoor dispensing devices for two liter bottles. The Kedzierski U.S. Pat. No. 4,911,334 discloses a beverage dispenser for dispensing carbonated beverages from bottled beverages. The dispenser requires the bottle to be inverted and screwed into the dispenser. The patent fails to explain how the beverage remains in the container while, in the inverted position but prior to threading. Moreover, a complicated plunger system is used for dispensing operation.

Refrigerator type dispensers are also well known in the dispenser art. For example, the patents to Daves U.S. Pat. No. 3,814,293, Anderson U.S. Pat. No. 4,722,463, McCurdy et al U.S. Pat. No. 4,844,290 and Horne U.S. Pat. No. 5,024,353 all show dispensers for two liter bottles. The dispensers are not for outdoor use. Accordingly, there is a need for a multiple bottle beverage dispenser for outdoor use which provides a continuous seal on the bottle during use or nonuse.

SUMMARY OF THE INVENTION

It is a primary object of the present invention to provide a fluid delivery system having a slidably opening and closing tube device for use with two liter beverage bottle which is simple in design and construction.

A further object of the present invention is to provide a fluid delivery system having a slidably opening and closing tube device for use with two liter beverage bottles having a dispenser supports for holding the beverage bottles in an inverted position to allow the flow of the beverage and upon removal of the bottle will seal any remaining beverage inside the bottle.

Still another object of the present invention is to provide a fluid delivery system having a support cabinet including a plurality of dispenser supports to hold a plurality of beverage bottles for easy outdoor use.

Still a further object of the present invention is to provide a fluid delivery system having a slidably opening and closing tube device comprising a stationary outer tube and a slidable inner tube readily affixed to a beverage bottle cap unit for dispensing the beverage from the bottle.

Still another object of the present invention is to provide a fluid delivery system having a slidably opening and closing tube device which is simple in construction and inexpensive to manufacture.

There and other objects of the present invention will become clearly understood by referring to the following description and to the accompanying drawings wherein:

DESCRIPTION OF THE PREFERRED EMBODIMENT

Figure 1:
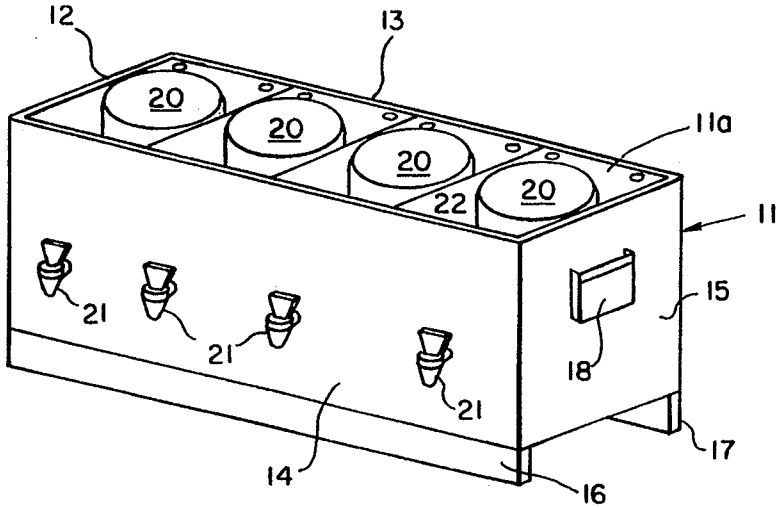
FIG. 1 illustrates an aerial view of the preferred embodiment of the subject dispenser cabinet.

With reference to FIG. 1, a dispenser 1 is illustrated in an aerial view. The dispenser includes a cabinet 11 having side walls 12, 13, 14, 15, and foot portions 16 and 17. The dispenser is for serving a soft drink or other liquid beverage from plastic containers 20. Located on side wall 15 is a holder 18 for cups. The foot portions permit dispensing of the soft drink into cups at a predetermined distance above the surface on which the dispenser is supported, such as a picnic table. Well known dispenser nozzles 21 are mounted on wall 14.

Figure 2:
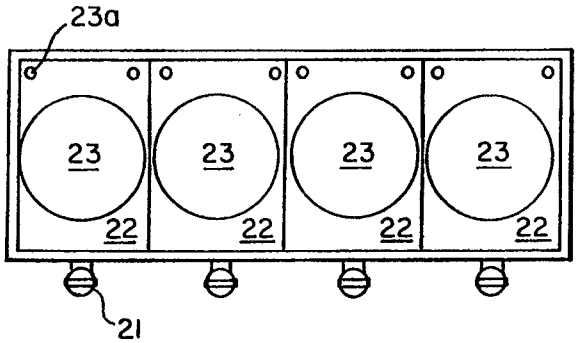
FIG. 2 illustrates a top plan view of the dispenser cabinet.

The dispenser cabinet 11 has an open top 11*a* for inserting the beverage containers. After the containers are positioned in the cabinet, support planks 22 are fitted around the containers as shown in FIGS. 1 and 2. Each support plank has a cut out portion 23 for tightly fitting around each bottle. Apertures 23*a* are provided for handling the planks. The planks are part of a support assembly which will later be described in detail. FIG. 2 is a top plan view of the dispenser cabinet.

Figure 3:
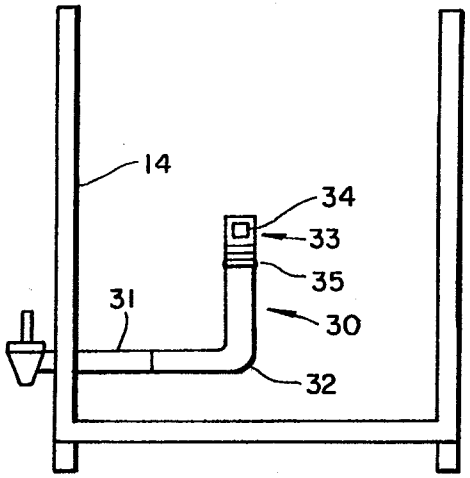
FIG. 3 illustrates a side cut out view of the cabinet partially assembled.

With reference to FIG. 3, a side cut out view of the dispenser cabinet 11 is shown with missing elements in order to provide a clear picture of the construction assembly. The cabinet is made of plastic. The view shows a portion of a fluid delivery system 30 used to present the beverage to dispenser nozzles 21. As shown, each dispenser nozzle is threadingly connected to cabinet tube 31 although only one fluid delivery system is shown in the drawing. The cabinet tube extends through the wall 14 and is connected to one end of arcuate pipe fitting 32. At the opposite end of fitting 32 is an aperture inlet fitting 33. The inlet fitting 33 has a rectangular opening 34 and an o-ring seal 35.

Figure 4:
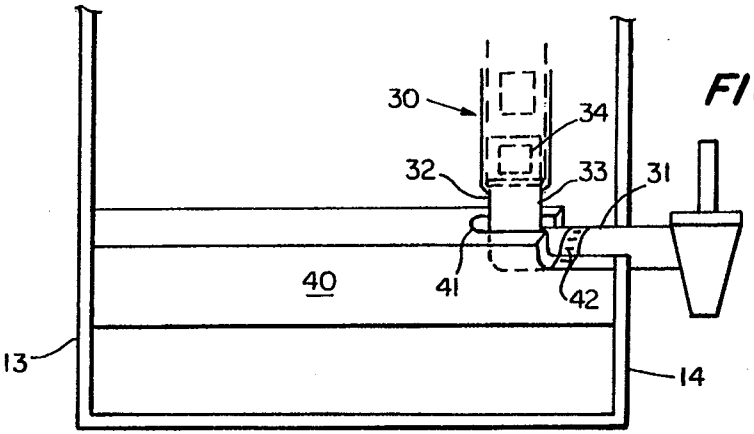
FIG. 4 illustrates a side cut out view of the cabinet fully assembled.

FIG. 4 illustrates another cut out side view of the dispenser cabinet with additional elements. The fluid delivery system 30 is shown supported in the cabinet by a base support 40. The base support is mounted to extend from the front wall 14 to the back wall 13. The base support is permanently attached to the dispenser cabinet.

The cabinet tube 31, the pipe fitting 32 and the inlet fitting 33 are directed through a channel 41 in the base support 40. A bracket 42 is secured to the base support by screws or other means. The base support is designed to firmly secure the fluid delivery system within the cabinet during removal of the bottles which will be described next. The upper portion of the inlet fitting 33 is essentially closed except for opening 34. The fitting provides a means for connecting the fluid delivering system 30 with the beverage bottle. In dotted lines is a cap unit which fits over fitting 33 and will now be described in detail.

Figure 5:
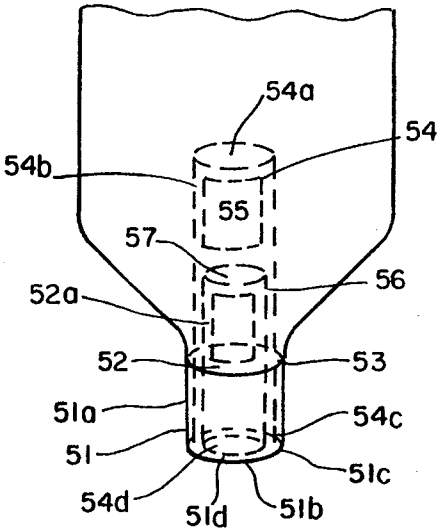
FIG. 5 is a plan view of the cap unit attached to an inverted beverage bottle.

Turning to FIG. 5 a container is shown in the inverted position having a cap unit 50 attached and closed. The cap unit 50 permits a user to attach a container 20 to the fluid delivering system without spilling the beverage. The cap unit 50 has a threaded cap portion 51 which connects with standard threads on the beverage container. Positioned within the cap portion is a sliding tube 52 and a stationary tube 55. The cap portion includes an outer wall 51*a* and a bottom wall 51*b* which has a central aperture 51*c*. The stationary tube 55 is integral with upper surface 51*d* of the bottom wall and includes an aperture 54, a top wall 54*a*, a side wall 54*b* and a bottom stop 54*c* which forms opening 54*d*. The sliding tube 52 has a side wall 52*a* an o-ring or seal means 53, a side aperture 56, a top wall 57 and bottom opening 52*b*.

Figure 7:
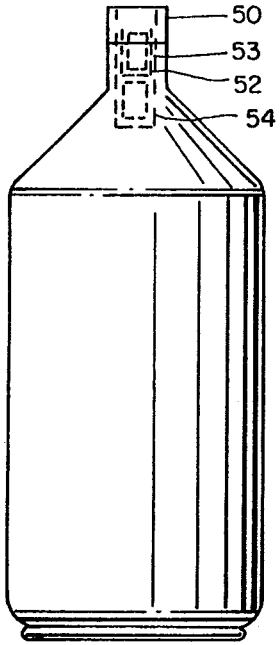
FIG. 7 is a plan view of the beverage bottle and cap unit.

In order to now connect the beverage container to the inlet delivery tube, the container is positioned with the cap unit axially aligned with the inlet delivery tube. The beverage unit is then pushed down so the inlet tube is received within the cap unit sliding the sliding tube upwardly until the apertures 54 and 56 and inlet tube opening 34 align. Fluid will then fill the fluid delivery system. The seal means provides a seal during the entire dispensing operation as sealing force is made between walls 52*a* and 54*b*. Upon removal of the container, the sliding tube returns to a closed position with sealing means 53 again sealing the container. The beverage can then be used again without going flat. FIG. 7 illustrates the cap closed and the bottle upright after use.

Figure 6:
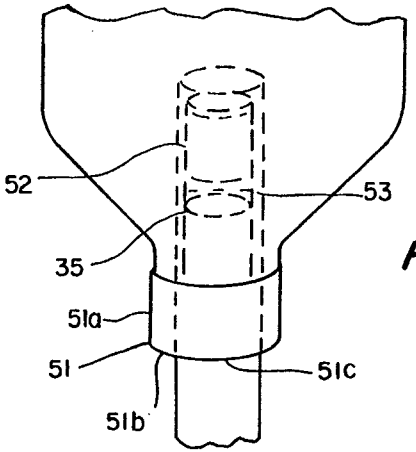
FIG. 6 is a partial view of a beverage bottle attached to the inlet tube.

Also shown in dotted lines in FIG. 6 is the seal 35. The seal 35 serves not only to seal the flow of the beverage from the container to the inlet tube but also acts as a frictional gripping device to move the sliding tube from either an open or closed position. The seal, for example an o-ring, grips inner wall 52*c* of the sliding tube and forces movement in the direction provided by the pull of the user on the container. The base 40 acts to secure the fluid delivery system during the tapping operation.

Figure 8A:
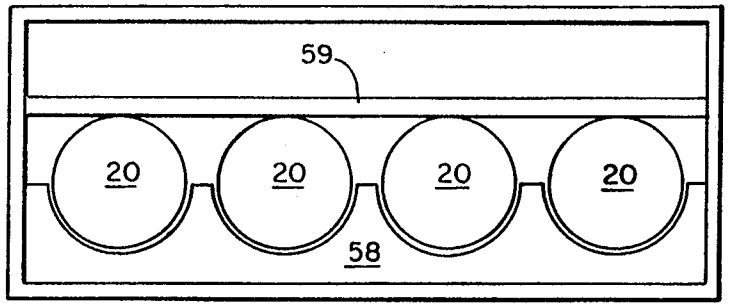
FIG. 8*a* is a top plan view of the cabinet partially assembled.
Figure 8B:
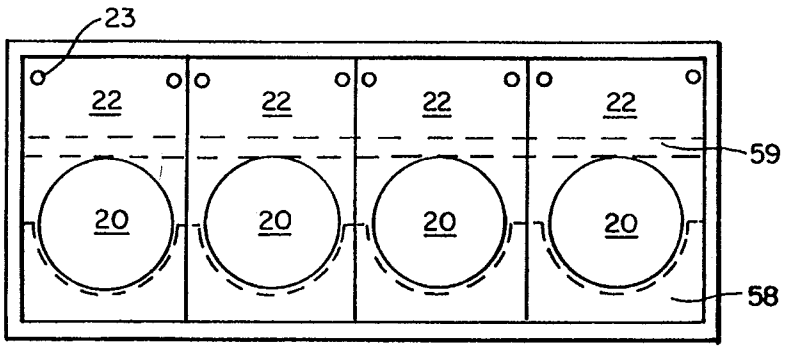
FIG. 8*b* is a top plan view of the cabinet fully assembled.

The two liter beverage containers 20 are supported in part by a support assembly as shown in FIGS. 8*a* and 8*b*. FIG. 8*a* illustrates a support shelf 58 having arcuate cut outs 58*a* for receiving a portion of each container. On the opposite side of the containers is a support bar 59. Both the support shelf and the support bar are formed integral with or permanently attached to the cabinet. After the containers are positioned in the cabinet, support planks 22 are placed over each bottle. The planks rest on the plate and the bar. The planks are handled through the use of apertures 23.

Figure 9:
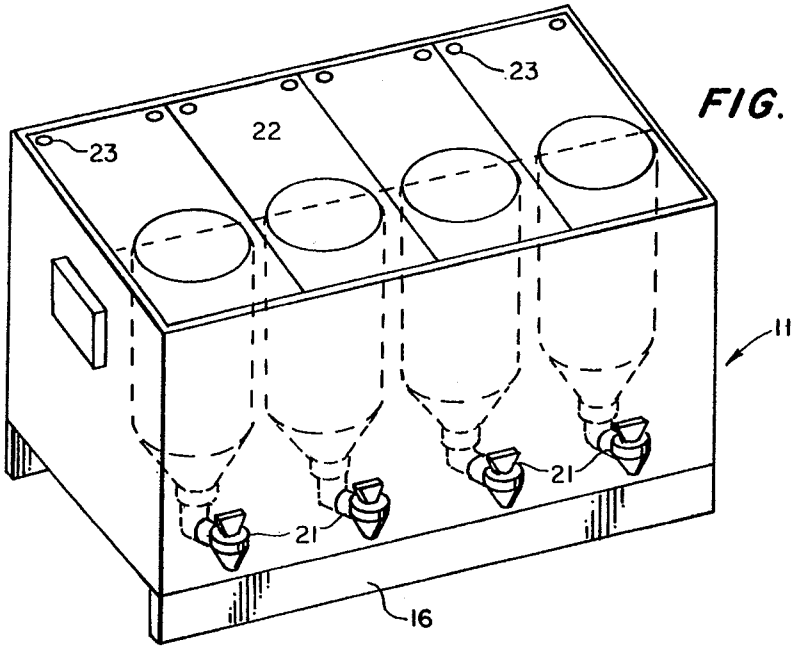
FIG. 9 is an aerial view of the dispenser cabinet.

Turning to FIG. 9 another aerial view of the dispenser unit is illustrated. The planks 22 are in place and help support the containers 20.

Figure 10:
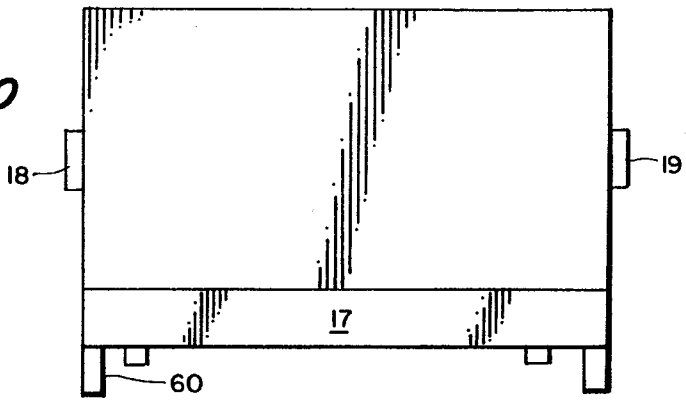
FIG. 10 is rear view of the dispenser cabinet.

Referring now to FIG. 10, the dispenser cabinet is shown including attachable legs 60. The legs are attachable to the dispenser by threaded sockets. The legs may also be of the telescopic type to raise the dispenser at a suitable height above the support surface. Located on each side wall of the cabinet are holders 18 and 19 for cups and cap units.

In operation, the user places the dispenser on a level surface. A cap from each beverage bottle is removed and replaced with a cap unit 50. Each bottle is inverted and the cap units are aligned with the inlet fittings 31. After alignment, the bottles are pushed downward until the closed end of each sliding tube is flush with each end of the stationary tube and the openings are aligned. The dispenser nozzles can then be operated to dispense a soft drink from a selected beverage. The planks, may then be fitted around each bottle for securely, supporting the system.

After use each bottle is pulled upwardly off fluid delivery systems out of the cabinet. As each bottle is removed, the friction fit and seal of the sliding tube permits the tube to slide down and immediate seal the bottle before the cap unit is off the inlet fitting. The bottles are now ready for refrigeration without losing any carbonization.

With this invention thus explained, it is apparent that numerous modification and variations can be made without departing from the scope and spirit of this invention. It is there fore intended that this invention be limited only as indicated in the appended claims.

I claim:

1. A dispenser for dispensing beverage from a beverage bottle, the dispenser comprising:

a cabinet defining a housing with at least one dispenser nozzle attached to said cabinet housing;

at least one tube attached to said dispenser nozzle and terminating at an inlet fitting tube having at least one side aperture; and a cap unit for use on the beverage bottle, said cap unit including a cap portion, said cap portion having an apertured top wall integrally connected to a stationary tube having one closed end and at least one side aperture in the stationary tube, a sliding tube, said sliding tube slidingly located within said stationary tube through said apertured top wall, said sliding tube having a closed end, at least one side aperture and a seal means positioned around said sliding tube to form a seal between said stationary tube and said sliding tube, and said sliding tube being movable to an open position from a closed position when said cap portion is placed over the inlet fitting tube and said inlet fitting tube moves the sliding tube such that the side apertures of said inlet fitting tube, sliding tube and stationary tube are all aligned.

2. A dispenser cabinet according to claim 1, said cap portion further comprising stop means for limiting movement of said sliding tube within said stationary tube.

3. A dispenser cabinet according to claim 1, wherein said seal means comprises an o-ring adhered to an outer wall of said sliding tube to provide a continuous seal between said stationary tube and said sliding tube.

4. A dispenser, said dispenser including a cabinet for receiving at leas tone beverage bottle, said dispenser comprising:

a fluid delivery system, said fluid delivery system having at least one dispenser nozzle, at least one inlet pipe fitting having at least one side aperture and being connected to said dispenser nozzle and to means for supporting said pipe fitting in said cabinet, and a cap unit for use on said beverage bottle, said cap unit including a cap portion, said cap portion having an apertured top wall integrally connected to a stationary tube having one closed end and at least one side aperture in the stationary tube, a sliding tube, said sliding tube slidingly located within said stationary tube through said apertured top wall, said sliding tube having a closed end, at least one side aperture and a seal means positioned around said sliding tube to form a seal between said stationary tube and said sliding tube, and said sliding tube being movable to an open position from a closed position when said cap portion is placed over the inlet pipe fitting and said inlet pipe fitting moves the sliding tube such that the side apertures of said inlet pipe fitting, sliding tube and stationary tube are all aligned.

5. A dispenser cabinet according to claim 4, said cap portion further comprising stop means for limiting movement of said sliding tube within said stationary tube.

6. A dispenser cabinet according to claim 4, wherein said seal means comprises an o-ring attached to an outer wall of said sliding tube to provide a continuous seal between said stationary tube and said sliding tube.

7. A dispenser according to claim 4, wherein said inlet pipe fitting includes an outer seal means for sealing.

8. A dispenser according to claim 4, said cabinet further comprising support means for supporting said beverage bottle within said dispenser.

* * * * *